US005703025A

United States Patent [19]

Zyngier et al.

[11] Patent Number: 5,703,025

[45] Date of Patent: Dec. 30, 1997

[54] MONOHYDRIC ALCOHOL-FREE PROCESS FOR MAKING A TRANSPARENT POUR MOLDED PERSONAL CLEANSING BAR

[75] Inventors: Alexandre Zyngier, Caracas, Venezuela; Benjamin Carl Wiegand, Hamilton, Ohio; Alejandro Figueroa, Cincinnati, Ohio; Michael August Brunsman, Cincinnati, Ohio

[73] Assignee: The Procter & Gamble Company, Cincinnati, Ohio

[21] Appl. No.: 493,351

[22] Filed: Jul. 21, 1995

Related U.S. Application Data

[63] Continuation-in-part of Ser. No. 285,261, Aug. 3, 1994, abandoned.

[51] Int. Cl.[6] ..... C11D 9/00; C11D 17/00; C11D 9/22

[52] U.S. Cl. ..... 510/147; 510/152; 510/153; 510/155; 510/156

[58] Field of Search ..... 252/108, 367, 252/368, 369, DIG. 1, DIG. 16, DIG. 7, 174.19, 174.21, 554, 555, 162; 510/141, 147, 152, 155, 156

[56] References Cited

U.S. PATENT DOCUMENTS

| | | | |
|---|---|---|---|
| 4,165,293 | 8/1979 | Gordon | 252/118 |
| 4,206,069 | 6/1980 | Borello | 252/122 |
| 4,290,904 | 9/1981 | Poper et al. | 252/118 |
| 4,468,338 | 8/1984 | Lindberg | 252/105 |
| 4,474,683 | 10/1984 | Story et al. | 252/369 |
| 4,490,280 | 12/1984 | Joshi et al. | 252/368 |
| 4,504,433 | 3/1985 | Inui | 264/232 |
| 4,758,370 | 7/1988 | Jungermann et al. | 252/132 |
| 4,963,284 | 10/1990 | Novakovic et al. | 252/108 |
| 4,980,078 | 12/1990 | Verite et al. | 252/118 |
| 4,988,453 | 1/1991 | Chambers et al. | 252/122 |
| 5,002,685 | 3/1991 | Instone et al. | 252/118 |
| 5,041,234 | 8/1991 | Instone et al. | 252/118 |
| 5,082,600 | 1/1992 | Smith et al. | 252/547 |
| 5,204,014 | 4/1993 | Redd et al. | 252/117 |
| 5,264,144 | 11/1993 | Moroney et al. | 252/117 |
| 5,264,145 | 11/1993 | French et al. | 252/117 |
| 5,340,392 | 8/1994 | Kacher et al. | 252/112 |
| 5,340,492 | 8/1994 | Kacher et al. | 252/112 |

FOREIGN PATENT DOCUMENTS

| | | | |
|---|---|---|---|
| 62352 | 6/1982 | European Pat. Off. . | |
| 507559 A3 | 10/1992 | European Pat. Off. | C11D 10/04 |
| 633312 | 1/1995 | European Pat. Off. | C11D 17/00 |
| 57-30798 | 2/1982 | Japan | C11D 9/02 |
| 4328200 | 11/1992 | Japan | C11D 10/04 |
| 2121815 | 6/1987 | United Kingdom . | |

OTHER PUBLICATIONS

"Soap Manufacture" vol. I by J. Davidsohn, E.J. Better, and A. Davidsohn published by Interscience Publishers, Inc., New York 1953. A more detailed review can be found at pp. 465 to 472. No month available.

U.S. application No. 08/285,257, Wiegand et al., filed Aug. 3, 1994.

U.S. application No. 08/493,350, Wiegand et al., filed Jul. 21, 1995.

*Primary Examiner*—Paul Lieberman
*Assistant Examiner*—Necholus Ogden
*Attorney, Agent, or Firm*—Tara M. Rosnell

[57] ABSTRACT

This invention relates to a monohydric alcohol free process for making transparent pour molded personal cleansing bars which exhibit good hardness characteristics. The process comprises: (I) making a molten mixture of from 18 parts to 35 parts soap, wherein said soap is at least 50% insoluble sodium soap; from 14 parts to 32 parts water; from 5 parts to 37 parts synthetic surfactant; and from 18 parts to 37 parts of a water soluble organic solvent, wherein the combined level of water and water soluble organic solvent within the molten mixture is at least 40 parts; and (II) transferring a unit amount of said molten mixture into a bar forming mold or tube and (III) allowing said molded unit to cool in acquiescent conditions into a mild, low smearing transparent personal cleansing bar.

The preferred bars made by the process of the present invention are more weight stable than bars made with several parts of alcohol. An important benefit of this invention is that bar processing time is substantially reduced by faster crystallization and faster bar stabilization.

8 Claims, No Drawings

MONOHYDRIC ALCOHOL-FREE PROCESS FOR MAKING A TRANSPARENT POUR MOLDED PERSONAL CLEANSING BAR

This is a continuation-in-part of application Ser. No. 08/285,261, now abandoned, filed on Aug. 3, 1994.

TECHNICAL FIELD

This invention relates to a monohydric-alcohol-free process for making pour molded transparent and translucent personal cleansing bars. The transparent personal cleansing bars prepared according to this process exhibit good hardness characteristics and are mild to the skin, low smearing and good lathering.

BACKGROUND OF THE INVENTION

Transparent personal cleansing bars are well known in the art and are considered desirable by many consumers. Unfortunately, a problem in formulating transparent personal cleansing bars is that, either they can be too harsh, as in the case of bars containing high levels of soap, or they can require the use of monohydric alcohols, or they can be undesirably soft.

For example, U.S. Pat. No. 5,041,234 to Instone, et. al, issued Aug. 20, 1991, discloses a transparent bar which contains greater than 40 parts of soap (high soap bar). Like other "high soap" transparent bars, the bars disclosed by Instone et al. have good lather, low smear, and good bar hardness. Such high soap level transparent bars, however, are rather harsh to the skin. Another drawback to such bars is that their processing generally require the use of an undesirable solvent, such as volatile short chain monohydric alcohols, or require special milling to obtain transparency.

Transparent bars which contain lower levels of soap are also known in the art. "Lower soap" transparent bars contain less than 40 parts of soap. U.S. Pat. No. 5,002,685 to Chambers et al, issued Mar. 26, 1991, discloses a transparent bar made with 25 to 34% soap, 5 to 15% monohydric alcohol, 15 to 30% sugar and/or cyclic polyol, and 15 to 30% water. Unfortunately, transparent bars which are prepared according to a process, such as that described by Chambers et al., which requires the use of monohydric alcohols in the preparation of the transparent bar, are prone to excessive weight loss due to the volatile nature of most alcohols. Such transparent bars are also more expensive to prepare and require special equipment designed to accommodate the explosion hazard associated with most monohydric alcohols.

It would thus be desirable to be able to formulate transparent bars which are mild to the skin, which exhibit good hardness characteristics and which do not require the use of monohydric alcohols during the formulation. This invention relates to a monohydric-alcohol-free process for making pour molded transparent and translucent personal cleansing bars which exhibit good hardness characteristic.

SUMMARY OF THE INVENTION

This invention relates to a monohydric alcohol free process for making transparent pour molded personal cleansing bars which exhibit good hardness characteristics. The process comprises: (I) making a molten mixture of from 18 parts to 35 parts soap, wherein said soap is at least 50% insoluble sodium soap; from 14 parts to 32 parts water; from 5 parts to 37 parts synthetic surfactant; and from 18 parts to 37 parts of a water soluble organic solvent, wherein the combined level of water and water soluble organic solvent within the molten mixture is at least 40 parts; and (II) transferring a unit amount of said molten mixture into a bar forming mold or tube and (III) allowing said molded unit to cool in acquiescent conditions into a mild, low smearing transparent personal cleansing bar.

The preferred bars made by the process of the present invention are more weight stable than bars made with several parts of alcohol. An important benefit of this invention is that bar processing time is substantially reduced by faster crystallization and faster bar stabilization.

DETAILED DESCRIPTION OF THE INVENTION

This invention relates to an alcohol free process for making a transparent pour molded bar that exhibits good hardness characteristics. The process comprises: (A) making a molten mixture of from 18 parts to 35 parts soap, wherein said soap is composed of at least 50% insoluble sodium soap; from 14 parts to 32 parts water; from 5 parts to 37 parts synthetic surfactant wherein said lathering synthetic surfactant has a critical micelle concentration equilibrium surface tension between 10 and 50 dynes/cm, as measured at 25° C.; and from 18 parts to 37 parts of a water soluble organic solvent, wherein the combined level of water and water soluble organic solvent within the molten mixture is at least 40 parts; and (B) pouring said molten mixture into a bar forming mold or tube and allowing said poured molten mixture to cool in acquiescent conditions into a mild low smearing transparent personal cleansing bar.

For purposes of the present invention, a bar is considered to be transparent if 14 point type can be read through a ¼ inch thickness of the bar. A bar is not transparent if 14 point type cannot be read through a ¼ inch thickness of the bar. See, Gordon; U.S. Pat. No. 4,165,293; Issued Aug. 21, 1979, herein incorporated by reference.

As used herein, the term "insoluble soap" means a fatty acid sodium soap that is less soluble than sodium myristate.

The transparent bars made by the process of this invention do not contain monohydric alcohols and, thus, are very stable weight wise. Alcohol containing bars are prone to weight loss due to evaporation of the volatile alcohol. This is one benefit of excluding alcohol. Yet another benefit of excluding alcohol is that a simpler process may be used since processes using alcohol typically require special equipment designed to accommodate the explosion hazard associated with most monohydric alcohols. An alcohol free process is also more economical.

The levels, parts, percentages and ratios herein are by weight unless otherwise specified. Note that the "soap mixtures" are expressed herein as weight percent (wt. %) of the soap." On the other hand, "parts" are used herein as weight parts of the finished bar. All numerical limits, ranges, ratios, etc., are approximations unless otherwise specified.

The process of the present invention and the materials used therein are described in detail as follows.

POUR MOLDED PROCESS: This invention relates to an alcohol free process for making a transparent pour molded bar that exhibit good hardness characteristics. The process comprises: (A) making a molten mixture of from 18 parts to 35 parts of soap; wherein said soap is at least 50% insoluble sodium soap; from 14 parts to 32 parts water; from 5 parts to 37 parts synthetic surfactant wherein said lathering synthetic surfactant has a critical micelle concentration equilibrium surface tension between 10 and 50 dynes/cm, as measured at 25° C.; and from 18 parts to 37 parts of a water soluble organic solvent, wherein the combined level of water and water soluble organic solvent within the molten mixture is at least 40 parts; and (B) transferring a unit amount of said molten mixture into a bar forming mold or tube and allowing said molded unit to cool in acquiescent conditions into a mild low smearing transparent personal cleansing bar.

A preferred alcohol free process comprises the following steps:

1. Mix a mostly insoluble fatty material selected from the group consisting of: triglycerides and fatty acids with a water soluble polyol.

2. Add amphoteric surfactant(s), water, and some salt(s) e.g., sodium chloride with mixing;

3. Raise temperature of the mix of step 2 to 70° C. to 100° C. to provide a molten mix; while temperatures below 70° C. may be used, the reaction time will be slow and bar transparency and/or hardness may be negatively affected;

4. Add enough caustic solution to mix of step 3 to saponify the fatty material and to provide a low level of free caustic (e.g., 0.01 to 0.07%) after saponification/neutralization. This low level of residual caustic will ensure that all the fatty material has reacted. This is important to achieve the desired transparency and bar hardness since low levels of unreacted fatty material (particularly triglyceride) can affect these properties negatively. Cool if needed to prevent boiling; but maintain a molten mix;

5. Add some free fatty acid (at least enough to neutralize all the free caustic) and, optionally, other synthetic surfactants to mix of step 4.

6. Adjust mix temperature to a maximum of 85° C.;

7. Add other optional ingredients with mixing, maintain 68° C. to 85° C. temperature. Temperatures below 68° C. in presence of agitation may result in loss of transparency. Temperatures above 85° C. can be used but they will significantly increase the time required to cool the bar;

8. Pouring molten mix into bar molds or tubes;

9. Condition the mix in the bar molds or tubes to promote crystallization/solidification. Cooling must be conducted in acquiescent conditions at product temperatures below 68° C., otherwise, bar transparency and hardness will be negatively affected. Average cooling rates of 0.1° to 7.0° C. per minute are preferred to cool the bars and obtain improved transparency. Average cooling rates of about 0.07° C. per minute or lower can result in opaque bars;

10. If tubes are used, the soap plugs are sliced into bar sized plugs;

11. Stamp into formed bars and package said formed bars.

A preferred process is a framed bar process. Other processes such as injection molding can be used.

SOAP: The transparent bars prepared according to the process of the present invention comprise from about 18 parts to about 35 parts, preferably from about 20 parts to about 32 parts, more preferably from about 24 parts to about 32 parts soap. Surprisingly, at soap levels above about 35 parts a transparent bar is not produced, and at soap levels below about 18 parts the bar is unacceptably soft.

The soap mixture used in the process of this invention comprises at least 50% insoluble sodium soap, preferably from 50% to about 87% insoluble sodium soap, more preferably from about 53% to about 72% insoluble sodium soap. Transparent bars wherein the soap component contains less than 50% insoluble soap can be undesirably soft.

As hereinbefore described, the term "insoluble soap" is defined herein as: A fatty acid sodium soap that is less soluble than sodium myristate. In particular, the term "insoluble soap" refers to monovalent salts of saturated fatty monocarboxylic acids having a carbon chain length of from 16 to 24, preferably from 16 to 18. These monovalent salts would normally be sodium salts, although some cations, such as K, Mg or alkanolammonium ions could be used. The preferred insoluble fatty acid soap is selected from the group consisting of sodium palmitate and sodium stearate and mixtures thereof. Other insoluble soaps, particularly, higher fatty acid insoluble soaps, can also be used.

The remainder of the soap mixture is soluble soap. The term "soluble" soap refers to the monovalent salts of saturated fatty monocarboxylic acids having a carbon chain length of from 8 to 14 and additionally the monovalent salts of oleic acid and unsaturated fatty monocarboxylic acids having a carbon chain length of between 8 and 22. We define sodium myristate as a "soluble" soap. The preferred soluble soaps are selected from the group consisting of: myristic, oleic and lauric acid soaps and mixtures thereof.

The fatty acid soap used in the transparent bars of the present invention can be made using either pure chain fatty acids, mono-, di-, or triglycerides or oils, or by using the proper levels and ratios of common fatty acid and oil mixtures such as coconut, palm oil stearin, tallow, and triple pressed stearic.

The term "coconut" is defined herein in connection with soap or fatty acid mixtures to refer to materials having an approximate carbon chain length distribution of: 8% $C_8$; 7% $C_{10}$; 48% $C_{12}$; 17.5% $C_{14}$; 9% $C_{16}$; 2% $C_{18}$; 6% oleic and 2.5% linoleic. Coconut soap thus comprises approximately 11% insoluble soap and 89% soluble soap.

The term "babassu" is defined herein in connection with soap or fatty acid mixtures to refer to materials having an approximate carbon chain length distribution of: 6% $C_8$; 3% $C_{10}$; 46% $C_{12}$; 20% $C_{14}$; 7% $C_{16}$ and 18% $C_{18:1}$ oleic. Babassu soap thus comprises approximately 7% insoluble soap and 93% soluble soap.

The term "triple pressed stearic" as defined herein refers to fatty acids having an approximate chain length distribution of 5% myristic (C14), 50% palmitic (C16) and 45% stearic (C18). Triple pressed stearic soap thus comprises approximately 95% insoluble soap and 5% soluble soap.

The term "hardened tallow" is defined herein to refer to fatty materials having an approximate chain length distribution of 3% myristic (C14), 50% palmitic (C16) and 45% stearic (C18), and 2% oleic. Hardened tallow soap thus comprises approximately 95% insoluble soaps and 5% soluble soaps.

By comparison, "tallow" is defined (normalized mid range values from Table 6.34 Bailey's Industrial Oil and Fat Products, Volume 1, Wiley Intersciences) as a mixture of soaps having an approximate chain length distribution of: 4% C14; 29% C16; 20% C18; 2% palmitoleic; 42% oleic and 3% linoleic. Tallow soap thus comprises approximately 49% insoluble soap and 51% soluble soap.

The amount of free fatty acid incorporated into the finished bars prepared by the process of the invention typically ranges from 0.5 parts to 3 parts, more typically from 1 to 2 parts. However, no free fatty acid is required.

The free fatty acid component is preferably introduced into the soap mixtures used in the present invention by addition of fatty acid to the soap mixtures after the saponification of the soap mixture has taken place. The free fatty acid component can also be introduced as a prepared mixture of soap and free fatty acid, such as an acid-reacting mixture of soap and free fatty acid prepared by under-neutralization in the soap making process.

The fatty acid soap used in the present invention comprises sodium soaps. However, low levels of non-sodium soaps such as potassium, magnesium, and/or triethanolammonium (TEA) soaps are permissible. Such non-sodium soaps, when used, are preferably used at a level of from 0 to 10 parts, preferably from 0 to 5 parts by weight of the bar soap.

WATER: The water level in the transparent bars prepared by the process of the present invention ranges from about 14 parts to about 32 parts, preferably from about 18 parts to about 27 parts, more preferably from about 22 parts to about 26 parts. The higher levels of water within these preferred ranges are more preferred for processing ease, bar mildness and other advantages.

The water level within the personal cleansing bars prepared by the process of the present invention is critical to obtain a transparent bar having desirable hardness characteristics. When the water is less than about 14 parts by weight of the bar, the bar may not be transparent. When the level of water present in the bar exceeds about 32 parts by weight of the bar, the bar can be unacceptably soft.

SURFACTANT: The lathering synthetic surfactant level in the transparent bars prepared according to the process of the present invention ranges from about 5 parts to about 37 parts, preferably from about 10 parts to about 28 parts, more preferably from about 12 parts to about 22 parts by weight of the finished bar. The synthetic surfactant is necessary for improving bar characteristics. Some of these characteristics include lathering/sudsing properties, bar mildness, rinse feel of the bar, and smear/hardness characteristics.

The bar composition comprises a lathering synthetic surfactant selected from the group consisting of anionic surfactants; nonionic surfactants, zwitterionic surfactants, amphoteric surfactants, and mixtures thereof. The lathering surfactant is defined herein as a synthetic surfactant or a mixtures of surfactants that has an equilibrium surface tension of between 10 and 50 dynes/cm, more preferably between 20 and 45 dynes/cm as measured at the CMC (critical micelle concentration) at 25° C. Some surfactant mixtures have surface tensions lower than some of its components. Thereby both low and high lathering and high and low water-soluble surfactants can be used in the bar compositions of the present invention. Suds boosting synthetic detergent surfactants and/or synthetic detergent surfactants that are known as good dispersants for soap curds that are formed in hard water, are particularly desirable.

A preferable selection of lathering synthetic surfactant would include a mixture of anionic and zwitterionic/amphoteric surfactants. The addition of the zwitterionic/amphoteric surfactant allows for increased mildness and lather properties. However, this addition also can lead to worse structure forming properties in the bar, so that the amount of amphoteric surfactant should be kept to less than 10 parts. Preferred zwitterionic/amphoteric surfactants are selected from alkyl ampho mono and di-acetates, alkyl betaines, alkyl sultaines, alkyl amidopropyl betaines, alkyl amidopropyl hydroxysultaines, and mixtures thereof, wherein said surfactants contain C8 to C22 alkyl chains and mixtures thereof.

Examples of suitable synthetic surfactants for use herein are those described in U.S. Pat. No. 3,351,558, Zimmerer, issued Nov. 7, 1967, at column 6, line 70 to column 7, line 74, incorporated herein by reference; and U.S. Pat. No. 4,165,293 to Gordon, issued Aug. 21, 1979; U.S. Pat. No. 5,002,685 to Chambers and Instone, issued Mar. 26, 1991; U.S. Pat. No. 5,041,234 to Instone, et al., issued Aug. 20, 1991; all incorporated herein by reference in their entirety. They include alkyl sulfates, anionic acyl sarcosinates, methyl acyl taurates, N-acyl glutamates, acyl isethionates, alkyl sulfosuccinates, alkyl phosphate esters, ethoxylated alkyl phosphate esters, trideceth sulfates, protein condensates, mixtures of ethoxylated alkyl sulfates and alkyl amine oxides, betaines, sultaines, and mixtures thereof. Some preferred surfactants are the alkyl ether sulfates with 1 to 12 ethoxy groups, especially ammonium and sodium lauryl ether sulfates.

Synthetic sulfate detergents of special interest are the normally solid alkali metal salts of sulfuric acid esters of normal primary aliphatic alcohols having from 10 to 22 carbon atoms. Thus, the sodium and potassium salts of alkyl sulfuric acids obtained from the mixed higher alcohols derived by the reduction of tallow or by the reduction of coconut oil, palm oil, palm kernel oil, palm oil stearin, babassu kernel oil or other oils of the coconut group can be used herein.

Other aliphatic sulfuric acid esters can be suitably employed.

Certain hygroscopic synthetic surfactants which are normally used in liquids and which are very difficult to incorporate into normal cleansing bars are very compatible in the bars of the present invention. Thus, essentially all of the known synthetic surfactants which are useful in cleansing products are useful in the compositions of the present invention. The cleansing product patent literature is full of synthetic surfactant disclosures. Preferred synthetic surfactant systems are selectively designed for bar appearance, stability, lather, cleansing and mildness.

The preferred lathering synthetic surfactant is selected from the group consisting of: acyl isethionates, acyl sarcosinates, alkylglycerylether sulfonates, methylacyl taurates, paraffin sulfonates, linear alkyl benzene sulfonates, N-acyl glutamates, alkyl sulfosuccinates, alpha sulfo fatty acid esters, alkyl ether carboxylates, alkyl phosphate esters, ethoxylated alkyl phosphate esters, alpha olefin sulphonate, the alkyl ether sulfates (with 1 to 12 ethoxy groups), and mixtures thereof, wherein said surfactants contain C8 to C22 alkyl chain. The anionic surfactant is more preferred wherein said surfactants contain C8 to C18 alkyl chains and wherein the counterion is selected from the group consisting of: Na, K, NH4, N(CH2CH2OH)3.

Some specific examples of preferred surfactants are used in the Examples herein. Some examples of good mild, lather-enhancing, synthetic detergent surfactants are, e.g., sodium lauroyl sarcosinate, alkyl glyceryl ether sulfonate, sulfonated fatty esters, and sulfonated fatty acids It is noted that surfactant mildness can be measured by a skin barrier destruction test which is used to assess the irritancy potential of surfactants. In this test the milder the surfactant, the less the skin barrier is destroyed. Skin barrier destruction is measured by the relative amount of radiolabeled water (3H—H2O) which passes from the test solution through the skin epidermis into the physiological buffer contained in the diffusate chamber. This test is described by T. J. Franz in the *J. Invest. Dermatol.*, 1975, 64, pp. 190–195; and in U.S. Pat. No. 4,673,525, Small et al., issued Jun. 16, 1987, incorporated herein by reference. These references disclose a mild alkyl glyceryl ether sulfonate (AGS) surfactant based synbar comprising a "standard" alkyl glyceryl ether sulfonate mixture and define the criteria for a "mild surfactant." Barrier destruction testing is used to select mild surfactants. Some preferred mild synthetic surfactants are disclosed in the above cited Small et al. patent.

SOLVENT: The transparent bar prepared according to the process of the present invention comprises from about 18 parts to about 37 parts, preferably from about 20 parts to about 32 parts, more preferably from about 20 parts to about 28 parts, of a water soluble organic solvent. The water soluble organic solvent is preferably selected from the group consisting of urea, water soluble organic polyol and mixtures thereof. Urea can be used at a level of 0 to 8 parts, preferable 2 to 7 parts or 3 to 6 parts, but the total level of polyol and urea preferably should not exceed about 37 parts. Preferred water soluble organic polyols are selected from the group consisting of: propylene glycol, dipropylene glycol, butylene glycol, glycerine and ethylene glycol, 1,7-heptanediol, mono and polyethylene and propylene glycols of up to 8,000 molecular weight, mono-C1–4 alkyl ethers thereof, sorbitol, glycerol, mono- di- and triethanolamine, 2-amino-1-butanol, non-reducing sugars, such as sucrose, and mixtures thereof.

When used, the preferred non reducing sugar is used at a level of from about 1 part to about 10 parts, preferably from about 2 parts to about 7 parts, by weight of the bar. Unless otherwise specified, the term "sucrose" as used herein includes sucrose, its derivatives, and similar non-reducing sugars and similar polyols which are substantially stable at a soap processing temperature of up to about 210° F. (99° C.), e.g., trialose, raffinose, and stachyose; and sorbitol, lactitol and maltitol.

The water-soluble organic solvent is a necessary component of the transparent bars prepared according to the process of the present invention, required for bar transparency. Moreover, the particular level and type of water soluble organic solvent employed are important to optimization of the transparency of the personal cleansing bar.

COMBINATION OF COMPONENTS

In order to obtain a transparent bar, the personal cleansing bars prepared according to the process of the present invention must contain certain combined levels of soap and water soluble organic solvent. In particular, in addition to the minimum levels of both solvent and water hereinbefore recited, a minimum combined level of water soluble organic solvent and water of 40 parts by weight of the bar, preferably 45 parts by weight of the bar, is necessary to achieve transparency.

In order to obtain a transparent bar, it is also preferable that the water soluble organic solvent, water and soap be combined within the bar at certain ratios. In particular, the water and the water soluble organic solvent are preferably combined at a ratio of about 2:1 to 1:2, most preferably about 1:1, to maintain transparency. The soap and the water soluble solvent are preferably combined at a ratio of about 0.8:1 to about 2:1, more preferably from about 0.8:1 to 1.5:1. The ratio of the insoluble soap to soluble soap preferably ranges from about 1.2:1 to about 2.4:1, more preferably from about 1.7:1 to about 2.3:1.

ADDITIVES: The bar soap compositions prepared according to the process of the present invention can contain other additives commonly included in toilet bars such as perfumes, other fillers, sanitizing or anti microbial agents, dyes, and the like.

Some preferred bars of this invention contain at least 1 parts of another bar ingredient selected from: moisturizers, colorants, fillers, polymeric skin feel and mildness aids, perfumes, preservatives, and mixtures thereof.

Compatible salt and salt hydrates can be used as fillers. Some preferred salts are sodium chloride, sodium sulfate, disodium hydrogen phosphate, sodium pyrophosphate, sodium tetraborate.

Generally, compatible salts and salt hydrates include the sodium, potassium, magnesium, calcium, aluminum, lithium, and ammonium salts of inorganic acids and small (6 carbons or less) carboxylic or other organic acids, corresponding hydrates, and mixtures thereof, are applicable. The inorganic salts include chloride, bromide, sulfate, metasilicate, orthophosphate, pyrophosphate, polyphosphate, metaborate, tetraborate, and carbonate. The organic salts include acetate, formate, methyl sulfate, and citrate.

Water-soluble amine salts can also be used. Monoethanolamine, diethanolamine, and triethanolamine (TEA) chloride salts are preferred.

Aluminosilicates and other clays are useful in the present invention. Some preferred clays are disclosed in U.S. Pat. Nos. 4,605,509 and 4,274,975, incorporated herein by reference.

Other types of clays include zeolite, kaolinite, montmorillonite, attapulgite, illite, bentonite, and halloysite. Another preferred clay is kaolin.

EXAMPLES

The following Examples illustrate the practice of this invention and are not intended to be limiting. All percentages, parts and ratios herein are by weight unless otherwise specified. The free fatty acids used in the examples are used at the same ratio as the fatty acid soaps. The soaps are made in situ, unless otherwise specified. The levels of soaps are given as a total soap weight percent (wt. %), as well as a bar weight parts.

The following process is used to make the exemplified framed bars. The process comprises the following steps:

1. Making a molten mixture batch step by step as indicated below.
2. Pouring molten mixture product in bar molds or tubes.
3. Cooling of bars in acquiescent conditions at an average cooling rate of 0.1° to 7.0° C. per minute to promote crystallization/solidification.
4. If poured in tubes, the soap plugs are sliced into bar sized plugs.
5. Stamp and package bars.

Batch Process

1. Mix triglycerides (e.g., Hardened Tallow) and/or fatty acids (e.g., Lauric Acid) with water soluble polyol (e.g., Propylene Glycol) in the Crutcher.
2. Add amphoteric surfactants (e.g., Coco Betaine), water, and salts (e.g., Sodium Chloride) to the crutcher.
3. Raise batch temperature to 70° C. to 100° C.
4. Add enough caustic solution (e.g., 30% Sodium Hydroxide) so that a low level of free caustic remains after saponification/neutralization. If necessary, cool batch to prevent boiling.
5. Add Free Fatty Acid to the batch.
6. Add other synthetic surfactants (e.g., Sodium Laureth-3 Sulfate) to batch as needed.
7. Adjust batch temperature to a maximum of 85° C.
8. Add other optional ingredients (e.g., Sugar, Perfume) to batch, maintain 68° C. to 85° C. batch temperature.

The temperatures listed in the batch making procedure are approximates. The temperatures in the process can vary some, e.g., they may vary within 5 degrees C. The key is not to allow the molten mix viscosity to get too high (e.g., below 68° C.), and to avoid agitation while cooling the mix in the proximity of this temperature range.

It is important to have the polyol solvent and preferably some amphoteric surfactant in the mix before neutralization of the fatty material. This promotes a lower viscosity. A lower viscosity is important for saponification speed.

It is also preferred to add the more hydrolysis sensitive surfactants to the molten mixture after saponification.

| Ingredient | Bar Wt. parts | Soluble | Insoluble |
|---|---|---|---|
| Babassu Soap | 10.5 | 9.8 | 0.7 |
| Hardened Tallow Soap | 19.5 | 0.9 | 18.6 |
| Triple Pressed Fatty Acid | 0.5 | | |
| Propylene Glycol | 11.0 | | |
| Dipropylene Glycol | 5.5 | | |
| Glycerine | 6.0 | | |
| Sodium Lauryl Ethoxy (3) Sulfate | 12.0 | | |
| Sodium Lauryl Sulfate | 3.0 | | |
| Coco Betaine | 2.0 | | |
| NaCl | 1.5 | | |
| Sugar | 2.0 | | |
| Water | 24.3 | | |
| Other | 2.2 | | |
| Totals | 100.00 | 10.7 (35.7%) | 19.3 (64.3%) |

This is the highly preferred bar made by the process of the present invention. The following processing conditions were used to make this bar:

1. Mix babassu, hardened tallow, propylene glycol, dipropylene glycol, glycerin, water, sodium chloride, and coco betaine in the crutcher and adjust batch temperature to 75° C.±2° C.

2. Add 30% caustic soda to batch with mixing. Temperature reaches 99° C. after the reaction.

3. Analyze for free caustic (result is within expected 0.01 to 0.07% range).

4. Add fatty acid, sodium lauryl ethoxy(3) sulfate, Sodium Lauryl Sulfate, Sucrose and minor ingredients with agitation. Batch temperature is at least 74° C. at all times. Control final batch temperature at 73° C.±2° C.

5. Transfer molten mix to solidification tubes.

6. Cool with forced air under acquiescent conditions at an average rate of approximately 0.2° C. per minute.

7. Push solid soap out of the tubes with pressurized water after cooling is completed (average soap temperature is less than 52° C.).

8. Slice soap plug and stamp into bars.

9. Pack in conventional bar soap packing equipment.

The above product is also cooled at average cooling rates of approximately 0.7, 0.3 and 0.06° C. per minute. The slowest cooling rate (0.06° C. per minute) results in opaque bars while the other two produced transparent bars.

The pour molded personal cleansing bar of this Example 1 had a weight loss of less than 4% after being stored at room temperature (21° C.) for six months. This weight loss is considered acceptable in the industry, and is significantly lower than that typically experienced by monohydric alcohol-containing personal cleansing bars. By comparison, a soap bar originally containing 42.5 parts of at least 50% soluble soap, 9.0 parts ethanol, 22.3 parts water and 19.5 parts of a combination of water soluble polyols experienced a weight loss higher than 4% after only two months of storage at room temperature (21° C.) conditions, and experienced a weight loss in excess of 12% after six months of being stored at this conditions.

| Ingredient | Bar Wt. parts | Soluble | Insoluble |
|---|---|---|---|
| Coconut Soap | 7.8 | 6.9 | 0.9 |
| Hardened Tallow Soap | 18.2 | 0.9 | 17.3 |
| Triple Pressed Fatty Acid | 1.0 | | |
| Propylene Glycol | 12.0 | | |
| Dipropylene Glycol | 6.0 | | |
| Glycerine | 6.0 | | |
| Sodium Lauryl Ethoxy (3) Sulfate | 10.0 | | |
| Alkylglycerylether Sulfonate | 2.0 | | |
| Disodium Lauroyl Sulfosuccinate | 1.0 | | |
| Sodium Lauryl Sarcosinate | 2.0 | | |
| Coco Betaine | 3.0 | | |
| Cocoamidopropyl Hydroxysulatine | 2.0 | | |
| NaCl | 1.5 | | |
| Sugar | 2.5 | | |
| Water | 22.8 | | |
| Sodium Citrate | 0.5 | | |
| Other | 1.7 | | |
| Totals | 100.00 | 7.8 (30%) | 18.2 (70%) |

This bar has excellent transparency, hardness and sudsing characteristics. The bar is also very mild.

A molten mix comprising the above composition is cooled in solidification tubes from a temperature of 72° C. to a solidification temperature of about 50° C. at an average cooling rate of 0.2° C. per minute. The molten mix is separately poured in bar shaped molds at a temperature of 72° C. and cooled in acquiescent conditions inside a cooling tunnel at an average rate of 1.3° C. per minute. In both cases, the bars obtained showed excellent properties.

A molten mix of the same composition is initially cooled from 82° C. to a temperature of 65° C. in presence of agitation. The mix is then poured in molds and cooled in acquiescent conditions at an average cooling rate of 1.3° C. per minute. The resulting bars are not transparent, but they retain good hardness and sudsing properties.

| Ingredient | Bar Wt parts | Soluble | Insoluble |
|---|---|---|---|
| Cn Soap | 12.60 | 11.21 | 1.39 |
| Hardened Tallow Soap | 15.40 | 0.77 | 14.63 |
| Triple Pressed FA | 2.00 | | |
| Propylene Glycol | 16.81 | | |
| Glycerine | 3.19 | | |
| Sodium Lauryl Ethoxy (3) Sulfate | 12.00 | | |
| Coco Betaine | 2.00 | | |
| NaCl | 1.50 | | |
| K2SO4 | 1.00 | | |
| Sugar | 4.50 | | |
| Water | 26.96 | | |
| Perfume | 1.80 | | |
| Preservative | 0.21 | | |
| Misc. | 0.03 | | |
| Totals | 100.00 | 11.98 (43%) | 16.02(57%) |

This is another preferred bar made by the process of the present invention. As shown in the "Totals", this bar contains 57% insoluble soap and 43% soluble soap. This bar exhibits good transparency properties, has excellent mildness and sudsing characteristics and has good bar structure. This bar was made using triglycerides as the structure former. The lathering synthetic surfactant system of this bar has an equilibrium surface tension of about 29 dynes/cm.

| Ingredient | Wt. parts | Soluble | Insoluble |
|---|---|---|---|
| Cn Soap | 11.20 | 9.97 | 1.23 |
| Hardened Tallow Soap | 16.80 | 0.84 | 15.96 |
| Triple Pressed FA | 2.00 | | |
| Propylene Glycol | 11.97 | | |
| Glycerine | 8.00 | | |
| Sodium Lauryl Ethoxy (3) Sulfate | 9.00 | | |
| Sodium Lauryl Sulfate | 3.00 | | |
| Coco Betaine | 2.00 | | |
| NaCl | 1.50 | | |
| K2SO4 | 1.00 | | |
| Sugar | 4.50 | | |
| Water | 26.96 | | |
| Perfume | 1.80 | | |
| Preservative | 0.21 | | |
| Misc. | 0.03 | | |
| Totals | 100.00 | 10.81 (39%) | 17.19 (61%) |

This is another preferred bar made by the process of the present invention. It contains 39% soluble soap and 61% insoluble soap. This bar also exhibits excellent bar performance properties, especially bar hardness. Note that this bar contains 8% Glycerine.

| Ingredient | Wt. parts | Soluble | Insoluble |
|---|---|---|---|
| Cn Soap | 15.53 | 13.82 | 1.71 |
| Triple Pressed Soap | 16.99 | 0.85 | 16.14 |
| Propylene Glycol | 25.24 | | |
| Glycerine | 2.09 | | |
| Sodium Lauryl Ethoxy (3) Sulfate | 11.65 | | |
| Coco Betaine | 0.97 | | |
| NaCl | 1.08 | | |
| TEA | 4.85 | | |
| Sugar | 4.85 | | |
| Water | 16.00 | | |
| Preservative | 0.21 | | |
| Perfume | 0.97 | | |
| Misc. | 0.03 | | |
| Totals | 100.00 | 14.67 (45%) | 17.85 (55%) |

This example has a higher amount of soap and a lower amount of water. This bar was made with a mixture of triglycerides (Coconut Oil) and fatty acids (Triple Pressed Stearic fatty acid).

| Ingredient | Wt. parts | Soluble | Insoluble |
|---|---|---|---|
| Cn Soap | 13.44 | 11.96 | 1.48 |
| Hardened Tallow Soap | 14.56 | 0.73 | 13.83 |
| Propylene Glycol | 20.00 | | |
| Glycerine | 3.21 | | |
| Sodium Lauryl Ethoxy (3) Sulfate | 8.00 | | |
| CocoBetaine | 1.00 | | |
| NaCl | 1.50 | | |
| K2SO4 | 1.00 | | |
| Sugar | 7.25 | | |
| Water | 27.8 | | |
| Preservative | 0.21 | | |
| Perfume | 1.00 | | |
| Misc. | 0.03 | | |
| Totals | 100.00 | 12.69(45%) | 15.31 (55%) |

This is an example of a bar with good bar performance characteristics, but with a lower synthetic surfactant level.

| Ingredient | Wt. parts | Soluble | Insoluble |
|---|---|---|---|
| Lauric Soap | 11.00 | 11.00 | 0.00 |
| Triple Pressed Soap | 16.50 | 0.82 | 15.68 |
| Propylene Glycol | 22.00 | | |
| Sodium Lauryl Ethoxy (3) Sulfate | 10.00 | | |
| Coco Betaine | 2.00 | | |
| TEA | 5.00 | | |
| NaCl | 1.00 | | |
| Urea | 5.00 | | |
| Water | 26.2 | | |
| Preservative | 0.21 | | |
| Perfume | 1.00 | | |
| Misc. | 0.06 | | |
| Totals | 100.00 | 11.82 (43%) | 15.68 (57%) |

This is an example of a bar that is made with only fatty acids. This bar has excellent performance characteristics. This bar is sugar free.

| Ingredient | Wt. parts | Soluble | Insoluble |
|---|---|---|---|
| Coconut Soap | 10.00 | 9.00 | 1.00 |
| Triple Pressed Soap | 15.00 | 0.75 | 14.25 |
| Triple pressed FA | 1.00 | | |
| Propylene Glycol | 20.00 | | |
| Glycerine | 5.00 | | |
| Sodium Lauryl Ethoxy (3) Sulfate | 10.00 | | |
| Coco Betaine | 1.00 | | |
| NaCl | 1.00 | | |
| Na2SO4 | 2.00 | | |
| Sugar | 5.00 | | |
| TEA | 2.00 | | |
| Water | 26.76 | | |
| Preservative | 0.21 | | |
| Perfume | 1.00 | | |
| Misc. | 0.03 | | |
| Totals | 100.00 | 9.75 (39%) | 15.25 (61%) |

This is an example of a bar that is made with only 25% soap, yet has excellent transparency and good performance characteristics.

What is claimed is:

1. A monohydric alcohol free process for making transparent pour molded personal cleansing soap bars, comprising the steps of:

I. making a molten mix of: (A) from 18 parts to 35 parts soap; wherein the soap is at least 50% insoluble sodium soap; (B) from 5 parts to 37 parts lathering synthetic surfactant, wherein the lathering synthetic surfactant has a critical micelle concentration equilibrium surface tension between 10 and 50 dynes/cm, as measured at 25° C.; (C) from 14 parts to 27 parts water; and (D) from 18 parts to 37 parts of a water soluble organic solvent, wherein the combined level of water and water soluble organic solvent within the bar is at least 40 parts;

II. transferring the molten mix to shaped bar molds or forming tubes, and

III. allowing the molten mix to cool under acquiescent conditions at an average rate of approximately 0.1° to 7.0° C. per minute, crystallize and solidify thereby providing said transparent personal cleansing soap bars; and wherein in step I, the temperature of the molten mix is adjusted to a temperature in the range of 68° C. to 85° C.; and wherein heat sensitive materials and optional bar soap ingredients are added to the molten mix in presence of agitation; and wherein the temperature of the molten mix is again adjusted to a temperature in the range of 68° C. to 85° C. before being poured into the bar shaped molds or forming tubes in step II.

2. The monohydric alcohol free process for making transparent personal cleansing soap bars in accordance with claim 1: wherein said water soluble organic solvent is selected from the group consisting of: propylene glycol dipropylene glycol, butylene glycol, glycerine and ethylene glycol, 1,7-heptane-diol, polyethylene and propylene glycols of up to 8,000 molecular weight, mono-C1–4 alkyl ethers thereof, sorbitol, glycerol, mono- di- and triethanolamine, 2-amino-1-butanol, non-reducing sugars and mixtures thereof.

3. The monohydric alcohol free process for making transparent pour molded personal cleansing soap bars in accordance with claim 2: wherein said lathering synthetic surfactant is selected from the group consisting of: acyl isethionates, acyl sarcosinates, alkylglycerylether sulfonates, methylacyl taurates, paraffin sulfonates, linear alkyl benzene sulfonates, N-acyl glutamates, alkyl sulfosuccinates, alpha sulfo fatty acid esters, alkyl ether carboxylates, alkyl phosphate esters, ethoxylated alkyl phosphate esters, alpha olefin sulphonate, the alkyl ether sulfates (with 1 to 12 ethoxy groups), and mixtures thereof, wherein said lathering synthetic surfactant contains C8 to C22 alkyl chain and mixtures thereof.

4. The monohydric alcohol free process for making transparent pour molded personal cleansing soap bars in accordance with claim 8 wherein the molten mix is prepared by 1) combining a fatty material selected from the group consisting of: triglycerides and fatty acids with said water soluble organic solvent, said water and said lathering synthetic surfactant to form a premix, 2) heating the premix to a temperature ranging from 70° C. to 100° C., and 3) adding a caustic solution to said premix to saponify said fatty material and thereby provide said molten mix.

5. The monohydric alcohol free process for making transparent pour molded personal cleansing soap bars in accordance with claim 4: wherein enough caustic is added to react all of said fatty material and to provide a very low level of excess caustic in said molten mix; wherein said low level of excess caustic is subsequently neutralized by the addition of free fatty acid.

6. The monohydric alcohol free process for making transparent pour molded personal cleansing soap bars in accordance with claim 5 wherein the temperature of said molten mix is adjusted to a temperature of from 68° C. to 85° C. after the excess caustic has been neutralized.

7. The monohydric alcohol free process for making transparent pour molded personal cleansing soap bars comprising the steps of:

I. making a molten mix of: (A) from 18 parts to 35 parts soap; wherein the soap is at least 50% insoluble sodium soap: (B) from 5 parts to 37 parts lathering synthetic surfactant, wherein the lathering synthetic surfactant has a critical micelle concentration equilibrium surface tension between 10 and 50 dynes/cm, as measured at 25° C.; (C) from 14 parts to 27 parts water; and (D) from 18 parts to 37 parts of a water soluble organic solvent, wherein the combined level of water and water soluble organic solvent within the bar is at least 40 parts;

wherein the molten mix is prepared by 1) combining a fatty material selected from the group consisting of triglycerides and fatty acids with said water soluble organic solvent, said water and a first portion of said lathering, synthetic surfactant to provide a premix, 2) heating the premix to a temperature of from 70° C. to 100° C., 3) adding enough caustic solution to said premix to saponify all said fatty material and to provide the molten mix with a low level of excess caustic, 4) adjusting the temperature of molten mix to from 68° C. to 85° C., and 5) adding free fatty acid and a second portion of said lathering synthetic surfactant to said molten mix;

II. transferring the molten mix to shaped bar molds or tubes, and

III. allowing the molten mix to cool under acquiescent conditions at an average rate of approximately 0.1 to 7.0° C. per minute, crystallize and solidify thereby providing said transparent personal cleansing soap bars.

8. The monohydric alcohol free process for making transparent pour molded personal cleansing soap bars in accordance with claim 7: wherein said first portion of said synthetic surfactant is an amphoteric surfactant; and said second portion of said synthetic surfactant is an anionic lathering synthetic surfactant.

* * * * *